United States Patent [19]

Balinski et al.

[11] 4,063,391

[45] Dec. 20, 1977

[54] CEILING SYSTEM

[75] Inventors: Henry A. Balinski, Hoffman Estates; Robert C. Grupe, Jr., Algonquin, both of Ill.

[73] Assignee: United States Gypsum Company, Chicago, Ill.

[21] Appl. No.: 759,934

[22] Filed: Jan. 17, 1977

[51] Int. Cl.[2] ..... E04B 5/52

[52] U.S. Cl. ..... 52/1; 52/232; 52/496; 52/99

[58] Field of Search ..... 52/1, 232, 484, 496, 52/DIG. 5, DIG. 8, 99; 98/40 D

[56] References Cited

U.S. PATENT DOCUMENTS

| | | | |
|---|---|---|---|
| 3,062,298 | 11/1962 | Nash | 49/7 |
| 3,246,432 | 4/1966 | Young | 52/1 |
| 3,589,089 | 6/1971 | Kedel | 52/232 |
| 3,708,932 | 1/1973 | Bailey | 52/232 |
| 3,783,771 | 1/1974 | Hartzell | 98/40 D |

*Primary Examiner*—Price C. Faw, Jr.
*Assistant Examiner*—Henry Raduazo
*Attorney, Agent, or Firm*—Glenn W. Ohlson; Samuel Kurlandsky; Robert H. Robinson

[57] ABSTRACT

A support runner for use in suspended ceiling grid systems is disclosed with the support runner being useful in ceiling systems having an exposed flange for decorative purposes. The support runner comprises: a lower decorative trim member; an upper inverted T-runner; and, an intermediate spline member. The decorative trim member has a decorative lower surface and an engageable upper surface. A spline member is engaged about the engageable upper surface of the decorative trim and extends substantially along the full length of the decorative trim. The upper surface of the spline is an engageable slot. An inverted T-runner is supportingly engaged to the engageable upper surface slot of the spline and extends along the spline a distance sufficiently less than the length of spline and trim members to accommodate heat expansion distortion of the inverted T-runner. When the ceiling system is exposed to heat, the inverted T-runner continues to hold the ceiling panels even though the spline loses structural integrity and disengages the decorative trim.

30 Claims, 5 Drawing Figures

CEILING SYSTEM

BACKGROUND OF THE INVENTION

1. Field of the Invention

This invention relates to a support runner for use in suspended ceilings and the ceiling system made possible by use of the runner.

2. Description of the Prior Art

Suspended ceiling systems using inverted-T cross runners to support ceiling tile and the like are a common type of construction for office buildings and the like. In one type of design, the bottom portion of the inverted-T runner fits into kerfed areas in the ceiling tile and the ceiling tile present a continuous surface without exposure of the runner anywhere in the ceiling. In recent years, however, it has become desirable for appearance and design purposes to have an exposed runner to provide a highly decorative surface which interrupts the ceiling tile. Examples of various design of inverted-T runners having such a decorative surface are found in U.S. Pat. No. 2,767,440; U.S. Pat. No. 3,577,904; U.S. Pat. No. 3,757,668 and U.S. Pat. No. 3,207,057. Examples of modified runners to provide a highly decorative effect using a modification of the inverted-T runner include such designs as are disclosed in U.S. Pat. Nos. 3,596,425; 3,390,624; 3,440,789; and 3,301,165. Still other designs having a grooved decorative ceiling surface are shown in U.S. Pat. No. Des. 223,235 and U.S. Pat. No. 3,916,773. In each of these systems, the inverted-T runners are rigidly locked together to provide a rigid support for the ceiling system. A ceiling system provided by use of such supports has one serious deficiency. When the system is exposed to extreme heat, the T-runners expand and deform, and the ceiling tile fall from the T-runners as a result of this deformation.

Ceiling systems which overcome the problem of collapse upon exposure to heat have been almost nonexistent. One attempt to provide a fire guard in such systems is disclosed in U.S. Pat. No. 3,062,298, but this disclosure expressly provides for collapse of the ceiling to enable sprinkler devices to eliminate the fire. The only other known type of system is that which uses "knockout" portions in the runners and tees to accommodate expansion by controlled buckling, but the buckling then causes problems in retaining the ceiling tiles in place. It would be much more desirable to have the ceiling remain in place, and, if the ceiling is a fire-rated material, enable the ceiling to act as a fire barrier to prevent the fire from spreading to the supporting structure. To date, no known system has been provided for utilizing the decorative exposed flange with an inverted-T runner with construction sufficient to support the ceiling upon exposure to heat. The new and novel runners and ceiling systems provided in this invention make possible, for the first time, a ceiling system which overcomes all of the deficiencies of the prior known systems.

SUMMARY OF THE INVENTION

It is an object of this invention to provide a support runner for use in suspended ceiling systems wherein the support runner will continue to support the ceiling upon exposure to heat.

It is the further object of this invention to provide a support runner having a highly decorative exposed surface but which will support a ceiling upon exposure to heat.

It is a further object of this invention to provide a ceiling system having decorative exposed flanges and splines supported by runners and wherein the ceiling tile will be held in place upon exposure to heat.

The objects of this invention are accomplished by a support runner for use in a suspended ceiling system of the type wherein the ceiling has an exposed flange for decorative purposes, said support runner comprising: a decorative trim having a decorative lower surface an an engageable upper surface; a spline having a lower engageable surface engaging the decorative trim and an upper engageable surface engaging a supporting runner and having a length coextensive with the length of the engaged decorative trim; and inverted-T runner supportingly and movably engaged by the engageable upper surface of the spline and extending along the spline a distance sufficiently less than the length of the spline to accommodate heat distortion of the inverted-T runner; whereby when the ceiling system is exposed to heat the inverted-T runner continues to hold the ceiling even though the spline loses structural integrity and disengages the decorative trim. More particularly, the support runner for use in this invention has an exposed flange which is decorative in appearance. The exposed flange may be of any type of decorative design, however, one design that is particularly useful is that which has a groove along the exposed surface to create a shadow effect in the installed ceiling or which can be used as a means of attachment for partitions, spot lights, signs and the like. The upper outside edges of the trim have outwardly extending projections which are engageable by the lower inside edges of the spline. At the bottom exposed edge of the decorative trim, the groove is located between opposing flanged portions which are of sufficient width to conceal the spline and inverted-T-runner from view when suspended ceiling panels are supportingly positioned on the support runner. The decorative flange can be made of any commonly used extrusion material, including extruded metals, such as aluminum, but may also include wood or plastic which have adaptability to the particular type of design desired.

A spline comprises the interstitial member of the support runner. It separates the lower decorative trim from the upper inverted-T runner. Engageable upper and lower surfaces respectively engage the T-runner and decorative trim. Comprising the lower engageable edge are two downwardly disposed legs which form an open channel configuration. Inward projections forming grooves therebetween reside along the inside of the legs and supportingly engage the upper outside grooves of the decorative trim. From opposing upper outside edges of the spline, upwardly then inwardly disposed flanges form a slotted engageable edge which engages the opposing cross-portions of the inverted-T runner. The inwardly opposing flanges of the slot terminate a sufficient distance apart so that the webbed portion of the inverted-T runner does not contact them. Interstitially disposed between trim and inverted-T, the spline acts as a fuse when the support runner is exposed to heat. The spline is comprised of a material which will lose structural integrity when subjected to temperatures within the range of from about 200° to about 450° Fahrenheit. When this occurs the spline discontinues engagement with both the trim and inverted-T runner, and the trim will drop away as the spline deteriorates. Remaining after this disengagement, the inverted-T runner continues to support the ceiling panels.

Another particular feature of the support runner is the inverted-T runner. It is comprised of a separating inverted-T portion which is rigidly hinged at the upper edge. The upper edge portion may be provided with a stiffening portion. Upon disengagement with the spline, the inverted-T separates to roughly appear as an inverted "V" with generally horizontally disposed cross-portions outwardly projecting from the bottom ends of the legs of the inverted "V". It is this action which occurs when the spline loses structural integrity.

The inverted-T runner, engaged in the slotted spline, provides the support for the ceiling tile. When installed in position, the tile bear on the upper surface of the inwardly disposed flanges of the spline slot. Within the slot, the cross-portions of the inverted-T runner supportingly engage the spline. With exposure to heat, the spline bearing surface upon which the tile rest degrades and the tile subsequently bear directly on the upper surface of the cross-portions of the separating inverted-T runner. Tile commonly used in suspended ceiling systems shrink upon exposure to heat. To maintain a bearing surface which will continue to support tile during horizontal contraction, the inverted-T member, as herein disclosed, separates upon deterioration of the spline member thereby providing support along the bearing surface of the cross-portion of the inverted-T for tile which experience shrinkage during exposure to heat. The decorative trim member has no tile supporting function, and as the spline loses its supporting ability, the trim disengages and drops away ungoverned by the inverted-T runner or ceiling tile reactions to heat.

Generally, the tile are cut so that they lie on the upper outside surfaces of the inwardly disposed flanges of the slot at the upper portion of the spline and extend downwardly so that the bottom surface of the ceiling tile is in a plane with the bottom surface of the exposed flange.

No transmission of deforming forces will occur from the trim to the inverted-T. An important object of this invention is thus presented. Since the spline comprises a material which will lose structural integrity at a much lower temperature than the temperature at which aluminum decorative trim could harmfully deform, the trim will be disengaged by the deteriorating spline with none of the distorting effects created by the deforming trim being transmitted to the inverted-T. Freed of the spline and trim, the inverted-T separates and remains supporting the ceiling tile. It is therefore a concomitant object of this invention to permit a variety of materials to comprise the decorative trim since the disengaging action of the spline is dependent upon temperature and not the material which comprises the decorative trim.

Another essential in the design of the support runners of this invention is that the inverted-T runner must not extend to the ends of the coextensive trim and spline members. The inverted-T runner must be discontinued near the ends of the trim and spline a distance sufficient to ensure that when the decorative flange drops away due to deterioration of the spline and the inverted-T runner begins to expand due to exposure to the heat, the inverted-T runner expansion will not be sufficient to cause the ends of the T-runner to contact each other rigidly and deform. This gap at the end of the runners can easily be determined by taking into account the particular material used in the inverted-T runner, considering the desired length and known linear coefficient of expansion and providing a safety margin for the particular temperature of heat exposure sought to protect against. When the installed ceiling system is exposed to heat from a flame or the like, the spline will lose structural integrity and the decorative trim will thereby be disengaged, but the inverted-T runner will continue to remain in place and support the ceiling tile to present a barrier against spread of flame.

Still other objects will readily present themselves to one skilled in the art upon reference to the following specification, the drawings and the claims.

DESCRIPTION OF THE DRAWINGS

This invention may be more fully described, but is not limited, by the attached drawings wherein.

DESCRIPTION OF THE PREFERRED EMBODIMENTS

This invention may be more fully described, but is not limited, by reference to the attached drawings and following discussion of the preferred embodiments discussed hereinafter.

Figure 1:
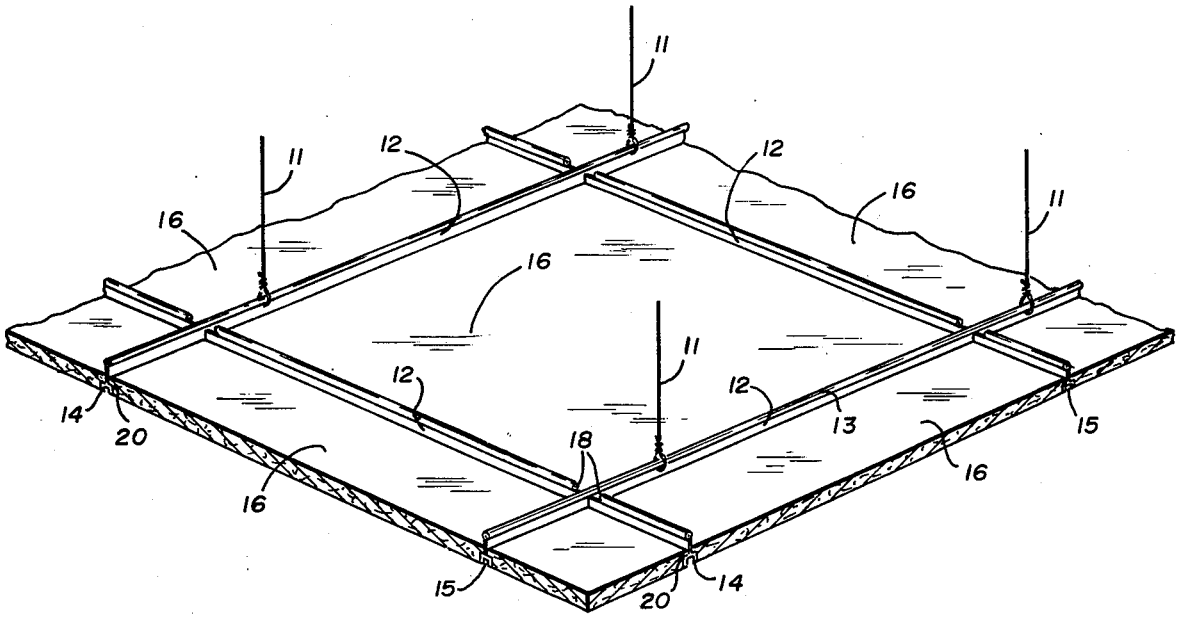
FIG. 1 is a top perspective view of an installed ceiling according to this invention.

FIG. 1 illustrates an installed ceiling system according to this invention wherein the ceiling system is supported by support wires 11 which are attached to a supporting structure. The supporting wires hold inverted-T runners 12, which may or may not have an enlarged upper portion 13 which stiffens the inverted-T runner and provides additional strength for the system. Spline members 20 engage inverted-T runners 12 and exposed flanges 14. Spline member 20 is disposed between the inverted-T runner and exposed flange whereby the spline connects the supporting inverted-T runner to the exposed flange with no direct physical engagement permitted between the inverted-T runner and exposed flange. The spline member may be comprised of one of many materials which have the required properties specified herein. Thus the use herein of the term "loss of structural integrity" includes the following descriptions which are used interchangeably in this disclosure: deterioration, degradation, melting, fusing, softening and descriptions verbalizing the physical behavior of suitable spline materials which lose structural integrity upon exposure to temperatures within the range of values from about 200° to about 450° Fahrenheit and thereupon disengage the decorative trim member and disengage from the inverted-T runner. Envisioned in the preferred embodiment of this invention herein disclosed are ceiling tile comprising a fire-rated material since it is an object of this invention to continue support for tile upon exposure to heat from a flame or the like. Also preferred is a fire retardant spline material which upon exposure to heat is non-flammable and does not produce toxic gases. Such suitable spline materials are among vinyls or other polymers of plastic which have fire retardant additives.

Figure 2:
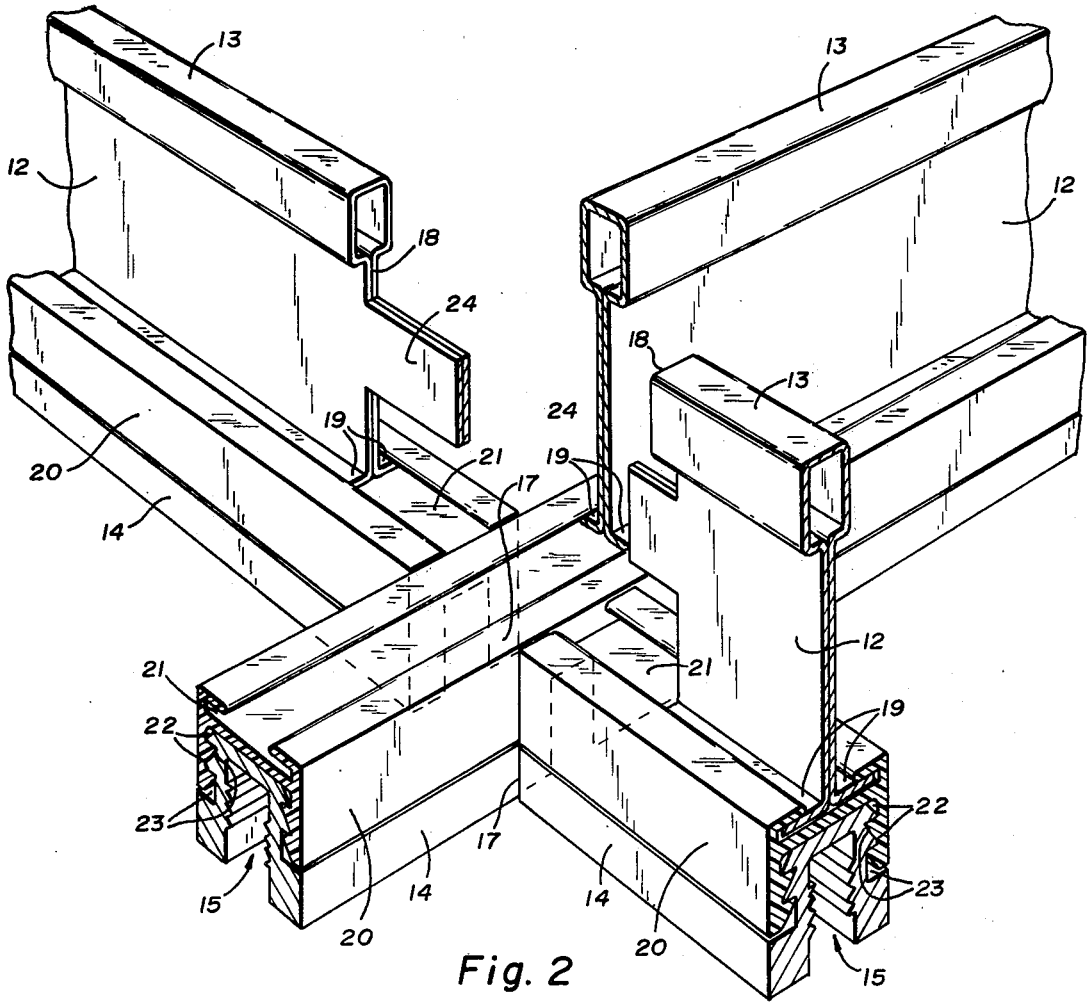
FIG. 2 is a perspective view illustrating the connection of ceiling runners according to this invention.

An exposed flange 14 provides a decorative surface underneath. A particularly desirable flange is one having a groove 15 on the underneath portion to create a shadow effect. The connective engagement by spline 20 of exposed flange 14 is made along the upper outsides of the exposed flange. As depicted in FIG. 2, the exposed flange and spline members have equal horizontal dimensions, as such, their vertical outside walls lie in coplanar relationship. The horizontal dimension of the spline can be made smaller than that of the exposed flange, but not larger, so that from below, only the decorative underneath side of the exposed flange is visible when cutout ceiling tile are used in the system. A desirable esthetic effect is created by concealing the spline and inverted-T runner from view in the ceiling system herein disclosed. Ceiling tile 16 are supported by the spline engaged inverted-T runner and may have this aforementioned cutout portion, if desired, to also enable the bottom surface thereof to be flush with the bottom surface of the exposed flange. In providing this flush configuration, cutout ceiling tile 16 allow the spline and inverted-T runner to be concealed from view as mentioned above.

Referring to FIG. 2, the exposed flanges 14 abut one another at ends 17 to provide a continuous decorative surface. In the preferred embodiment of this invention, spline member 20 engages the exposed flange 14 for the full length of the exposed flange and correspondingly co-terminates at ends 17. The inverted-T runners 12, however, are discontinued at ends 18 a distance sufficiently removed from the end of the exposed flange that expansion of the inverted-T runner, upon exposure to heat, will not cause the ends of the inverted-T runner to contact one another and deform due to the expansion. The inverted-T runners may be connected to one another in a conventional manner such as by flange 24, shown in FIGS. 2 and 3, at one end of an inverted-T runner engaging a slot in a second crossing inverted-T runner.

Figure 3:
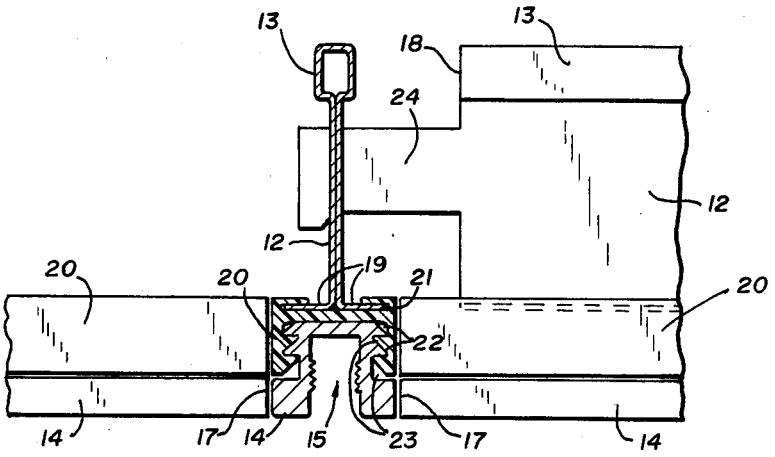
FIG. 3 is a cross-sectional view of an installed runner according to this invention showing the comprising members.
Figure 4:
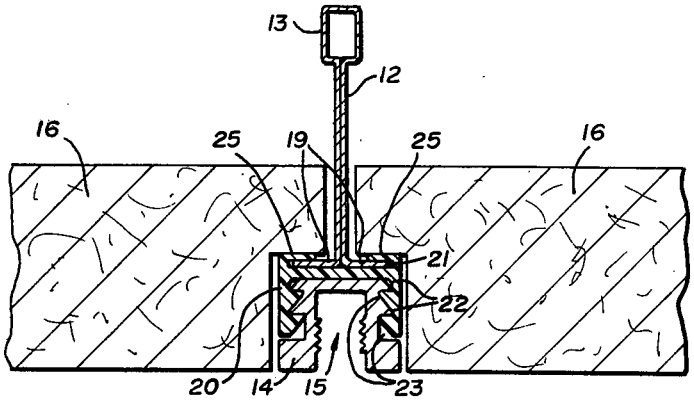
FIG. 4 is a cross-sectional view of an installed runner supporting ceiling tile according to the invention.

Focusing on the inverted-T runner 12, as shown in FIGS. 2, 3 and 4, the bottom engaging edge 19 is a cross-portion comprising the arms of the "T". At the upper edge, an optional stiffening portion 13 may be provided for strength. Engaging edge 19 movably engages spline 14 by means of slot 21. The top of slot 21 opens upwardly and the web portion of inverted-T runner 12 resides free from contact with the spline member when engaging edge 19 engages slot 21. A conventional roll-formed steel is envisioned as comprising inverted-T runner 12 so that fire resistance and supporting structural requirements for ceiling tile are both obtainable. It is the continuing support of ceiling tile upon exposure to heat that is the major feature of the invention as shown in FIG. 5, and a conventional roll-formed steel has the required properties for use in this invention.

The spline member 20, as shown in FIGS. 2, 3 and 4, is interstitially disposed between inverted-T runner 12 and exposed flange 14. Slot 21 is supportingly engaged by engaging edge 19 of inverted-T runner 12. Slot 21 is comprised of flanges extending upwardly then inwardly from the upper outside corners of spline 20 wherein the inwardly disposed flanges terminate to provide an opening in the top of the slot. Within this opening, the web portion of inverted-T runner 12 is disposed free from contact with spline 21. The bottom side of the inwardly disposed flanges of slot 21 bear on the top of cross-portion 19. The top side of the inwardly disposed flanges of slot 21 is the bearing surface for ceiling tile 16 on support edges 25 as shown in FIG. 4. Spline 20 engages exposed flange 14 by means of grooves 22 disposed along the insides of downwardly disposed outside walls. Grooves 22 grab the upper outside engageable grooves 23 of exposed flange 14. When installed, the support runner allows no contact between exposed flange 14 and inverted-T runner 12 as the spline member 20 is therebetween disposed. Slot 21 of spline 20 is a means for engaging inverted-T runner 12 which is separate and distinct engagement means from grooves 22 that engage exposed flange 14. Spline 20 is thus disclosed to be a connective device between the supporting inverted-T runner 12 and supported exposed flange 14.

Exposed flange 14, illustrated in FIGS. 2, 3 and 4 is shown to comprise a groove 15 on the underneath side which is of a generally rectangular shape having an open side at the underneath portion. The vertical walls of groove 15 have engageable grooves 23 on the outsides which are engaged by grooves 22 of spline 20. An extruded aluminum is envisioned as comprising the exposed flange in the preferred embodiments of the invention, although, other materials such as wood, plastic or rubber are equally adaptable to this invention. The non-engaged lower flanged portions of the walls of exposed flange 14 are shown to have sufficient width that when spline 20 engages exposed flange 14 the corresponding vertical sides of these coupled members lie in the same plane. It is desirable that the overall width of spline 20 be equal to, or smaller than, the overall width of exposed flange 14 so that, as viewed from below, the esthetic effect of observing only the decorative trim portion of the support runner herein disclosed is sustained.

Figure 5:
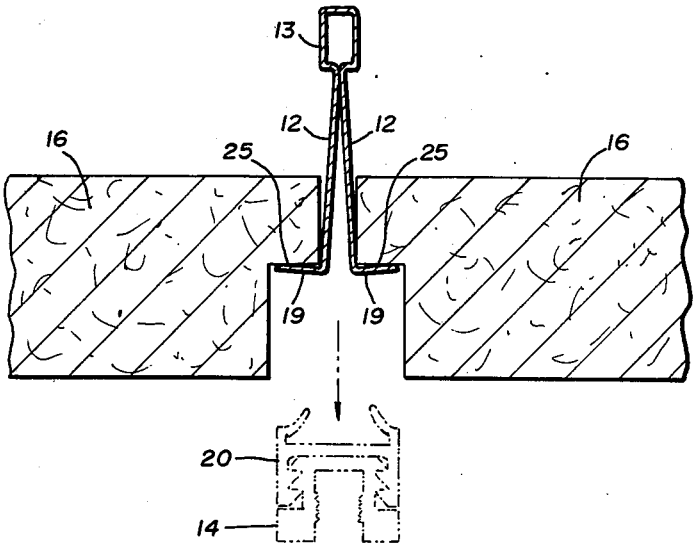
FIG. 5 depicts the installed runner shown in FIG. 4 continuing support for ceiling tile after disengagement of the spline and trim members due to exposure to heat.

FIG. 5 shows the major feature of this invention. Upon exposure to heat, spline 20, which in the preferred embodiment is comprised of a fire retardant material, undergoes loss of structural integrity when temperatures from a flame, or the like, reach values within the range of from about 200° to about 450° Fahrenheit. Within this range the spline willdeteriorate. Its connective performance will lessen. As the spline continues to degrade it will disengage from inverted-T runner 12 and exposed flange 14. That which occurs is a preventive action which prevents any debilitative heat deformation forces of the exposed flange from being transmitted to the inverted-T runner. Thus this action will cause a disengagement of exposed flange 14 from the support runner prior to reaching temperatures above about 450° Fahrenheit which otherwise would cause a harmful twisting and buckling of the aluminum envisioned as comprising exposed flange 14. Spline 20 degrades and exposed flange 14 drops away upon exposure to heat leaving inverted-T runner 12 to support ceiling tile.

FIG. 5 shows the inverted-T runner 12 after the disengagement last described. Along with the fuse action feature of this invention, a separating inverted-T is disclosed. Being connected only at the top, with or without stiffening portion 13, inverted-T runner will separate upon disengagement of cross-portion 19 with slot 21 of spline 20. During assembly of the support runner the web of the inverted-T runner is pinched such that cross-portion 19 fits within the slotted spline. Inverted-T runner 12 is in tension upon installation and engagement with engageable slot 21. Inverted-T runner 12 is, however, not rigidly fixed but movably engaged within slot 21 such that minor longitudinal expansion of the inverted-T occurring before disengagement of spline member 20 is permitted. The support runner of this invention will absorb this minimal expansion, which occurs in the inverted-T runner at temperatures lower than the temperature range at which the spline will degrade, by allowing the inverted-T to move within the spline slot. Upon exposure to sufficient heat the spline 20 will degrade, and disengage, leaving inverted-T runner 12 to relieve this tension by separating. The general shape, as shown in FIG. 5, after disengagement with spline 20, resembles an inverted "V" generally horizontally disposed cross-portions 19 at the bottom ends of the legs of this inverted "V". Separating to assume this configuration, inverted-T runner 12 continues to support cutout tiles 16 along their support edges 25. Support edge 25, which bears on the top side of the inwardly disposed flanges of slot 21 of spline 20 when the ceiling tile are installed, will bear on the top side bearing surface of cross-portions 19 as the spline degrades upon exposure to heat. Conventional ceiling tile 16 shrink upon exposure to heat from a flame or the like. To accommodate horizontal shrinking and lessening of bearing surface, the separation of inverted-T runner 12 is provided by this invention. In continuing to provide a supportive bearing surface, the support runner disclosed by this invention prevents contracting tile from dropping from the ceiling grid system herein disclosed. The benefits of providing a continuous barrier to the spread of a flame with this new and novel invention are most desirable to the construction industry involved with this art.

While only the preferred embodiment of this invention has been described, other forms and embodiments within the spirit and scope of the invention will become apparent to those skilled in the art. Therefore, the embodiment shown in the drawings is to be considered as illustrative in nature and not intended to limit the scope of the invention depicted and described herein.

A new and novel support runner and ceiling system is made possible by this invention providing capabilities heretofore totally unknown in the construction industry. For the first time a ceiling system has been provided with exposed decorative flanges capable of remaining in place to present a barrier to the spread of flames upon exposure to heat. A significant advance in the construction industry has been made by this novel invention.

Having fully described this new and unique invention the following is claimed:

1. A support runner for use in a suspended ceiling system of the type wherein the ceiling has an exposed flange for decorative purposes, said support runner comprising: a decorative trim member having a decorative lower surface and an engageable upper surface; a spline member having engageable upper and lower surfaces engaging the decorative trim member at the lower engagement surface and engaging an inverted-T runner at the upper engageable surface and extending substantially along the full length of the trim, said spline comprising a material which loses its structural integrity at a temperature of from about 200° to about 450° Fahrenheit thereby allowing the decorative trim member to drop away from the support runner and allowing the support runner to increase its supportability of the ceiling; and, an inverted-T runner supportingly and movably engaged within the engageable upper surface of the spline and extending along the spline a distance sufficiently less than the length of the spline to prevent heat distortion of the inverted-T runner; whereby when the ceiling system is exposed to heat the inverted-T runner continues to hold the ceiling even though the spline loses structural integrity due to heat and the decorative trim disengages from the spline.

2. A support runner for use in a suspended ceiling system, said support runner comprising a lower decorative trim member having a length sufficient to connect with other decorative trim members to provide a continuous ceiling trim design, said lower decorative trim member being engaged to a spline member extending substantially along the full length of the decorative trim member, said spline member being supportingly engaged by an inverted-T runner movably attached to the top of the spline member and said spline comprising a material which loses its structural integrity at a temperature of from about 200° to about 450° Fahrenheit thereby allowing the decorative trim member to drop away from the support runner and allowing the support runner to increase its supportability of the ceiling, said inverted-T runner being capable of supporting ceiling panels, and said inverted-T runner having a length sufficiently short to prevent distortion due to horizontal compression upon exposure to heat; whereby when the ceiling system is exposed to heat the inverted-T runner continues to hold the ceiling panels even though the spline loses structural integrity due to heat and the decorative trim disengages from the spline.

3. A support runner for use in a suspended ceiling system, said support runner comprising: a decorative trim member having a lower decorative surface and an upper holding surface, said upper holding surface comprising longitudinal grooves along the upper outside portions and extending longitudinally the length of the decorative trim member; and, a spline member having upper and lower holding surfaces, said lower holding surface comprising longitudinal grooves along the inside of opposing vertical wall portions capable of engaging the longitudinal grooves on the upper outsides of the decorative trim member, and said upper holding surface being a slot comprising upwardly then inwardly extending flanges extending from the opposing upper outside edges of the spline capable of engaging the flange portion of the inverted-T runner and said spline comprising a material which loses its structural integrity at a temperature of from about 200° to about 450° Fahrenheit thereby allowing the decorative trim member to drop away from the support runner and allowing the support runner to increase its supportability of the ceiling and an upper supporting member comprising an inverted-T runner capable of supporting ceiling panels and having spline engaging means movably engaging the upwardly then inwardly extending flanges of the spline member along the inverted-T runner, said inverted-T runner having a length sufficiently short that expansion due to heat exposure will not cause deformation due to contact with other runners in an installed ceiling system.

4. A support runner as in claim 3, wherein the decorative trim member has a groove extending along its lower surface.

5. A support runner as in claim 3, wherein the decorative trim member has an inverted U-shaped cross-section with grooves along the opposing upper outsides of the runner member capable of being engaged by the upper spline member.

6. A support runner as in claim 3, wherein the decorative trim member has an inverted U-shape and wherein the largest overall horizontal dimension is not less than the largest overall horizontal dimension of the engaging spline member.

7. A support runner as in claim 3, wherein the decorative trim member is of sufficient height that the lower surface of ceiling panels engaged by the support runner system and the lowest horizontal surface of the decorative trim member lie in the same horizontal plane.

8. A support runner as in claim 3, wherein at least one outside vertical surface of the spline member is in coplanar relationship with the corresponding outside vertical surface of the engaged decorative trim member.

9. A support runner as in claim 3, wherein respectively mated longitudinal grooves along the spline and decorative trim members have a common horizontal bearing surface which is parallel to the engageable horizontal slot at the top of the spline member.

10. A support runner as in claim 3, wherein the slot at the upper edge of the spline member is comprised of upwardly then inwardly extending flanges extending from the opposing upper outside edges of the spline member wherein the inwardly oriented flanges lie in coplanar horizontal relationship and wherein the slot is sufficiently open between the inwardly oriented flanges to allow movement of the vertical web portion of the supportingly engaged inverted-T runner.

11. A support runner as in claim 3, wherein the upper supporting member comprises an inverted-T runner having a rigid connection at its top portion wherein upon disengagement of the spline member due to exposure to heat the web of the inverted-T separates and the separated inverted-T runnercontinues to support the ceiling tile.

12. A support runner as in claim 3, wherein the upper supporting inverted-T runner member has a stiffening section on its top portion.

13. A support runner as in claim 3, wherein the upper supporting member comprises an inverted-T runner having the opposing cross-portions at the lower edge for engaging the spline member.

14. A support runner as in claim 3, wherein the decorative trim member comprises a hollow member formed with opposing outside upper portions being grooved and capable of being engaged by the spline member.

15. A support runner as in claim 3, wherein the spline member comprises a hollow channel with grooved opposing inside portions capable of engaging the decorative trim member.

16. A suspended ceiling in which suspended ceiling panels are retained in place even though an exposed supporting ceiling runner is exposed to heat sufficient to cause deformation of the exposed portion and loss of structural integrity by the spline portion, said ceiling comprising a plurality of interconnected support runners connected to a supporting structure and being ceiling panels resting on the support runners, said support runners comprising a decorative trim member having a decorative lower surface and an engageable upper outside surface, and a spline member having an engageable lower inside surface and an engageable slotted upper surface wherein said spline comprises a material which loses its structural integrity at a temperature of from about 200° to about 450° Fahrenheit thereby allowing the decorative trim member to drop away from the support runner and allowing the support runner to increase its supportability of the ceiling; and an inverted-T runner supportingly and movably engaged by the engageable slotted upper surface of the spline and extending along the spline a distance sufficiently less than the length of the decorative trim to prevent heat distortion of the inverted-T runner; whereby when the ceiling system is exposed to heat the inverted-T runner continues to hold the ceiling even though the spline loses structural integrity and disengages from the inverted-T runner and even though the decorative trim drops away upon disengagement from the spline.

17. A suspended ceiling in which suspended ceiling panels are retained in place even though an exposed supporting ceiling runner is exposed to heat sufficient to cause deformation of the exposed portion and loss of structural integrity by the spline portion, said ceiling comprising a plurality of interconnected support runners connected to a supporting structure with ceiling panels resting on the support runners, said support runners comprising a lower decorative trim member having a length sufficient to connect with other decorative trim members to provide a continuous ceiling trim design, said lower decorative trim member being engaged by a spline member extending substantially along the full length of the decorative trim member, said spline member being supportable by an inverted-T runner movably attached to the top of the spline member, said spline comprising a material which loses its structural integrity at a temperature of from about 200° to about 450° Fahrenheit thereby allowing the decorative trim member to drop away from the support runner and allowing the support runner to increase its supportability of the ceiling; said inverted-T runner being capable of supporting ceiling panels and said inverted-T runner having a length sufficient to prevent distortion due to horizontal compression upon exposure to heat whereby when the ceiling system is exposed to heat the inverted-T runner continues to hold the ceiling even though the spline loses structural integrity and disengages from the inverted-T runner and even though the decorative trim drops away upon disengagement from the spline.

18. A suspended ceiling in which suspended ceiling panels are retained in place even though an exposed supporting ceiling runner is exposed to heat sufficient to cause deformation of the exposed portion and loss of structural integrity by the spline portion, said ceiling comprising a plurality of interconnected support runners connected to a supporting structure with ceiling panels resting on the support runners, said support runners comprising a decorative trim member having a lower decorative surface and engageable upper outside surfaces, said upper outside holding surfaces comprising longitudinal grooves along the upper outside portions and extending longitudinally along the full length of the decorative trim; and a spline member having upper and lower holding surfaces, said lower holding surface comprising longitudinal grooves along the inside of opposing vertical wall portions, and said upper holding surface being a slot comprising upwardly then inwardly extending flanges extending from the opposing upper outside edges of the spline member, said spline comprising a material which loses its structural integrity at a temperature of from about 200° to about 450° Fahrenheit thereby allowing the decorative trim member to drop away from the support runner and allowing the support runner to increase its supportability of the ceiling; and an upper supporting member comprising an inverted-T runner capable of supporting ceiling panels and having spline engaging means engaging the upper holding slotted portion of the spline member in a manner which allows for movement of the inverted-T runner along the spline member, said inverted-T runner having a length sufficiently short that expansion due to heat exposure will not cause deformation due to contact with other runners in an installed ceiling system.

19. A suspended ceiling as in claim 18, wherein the decorative trim member has a groove extending along its lower surface.

20. A suspended ceiling as in claim 18, wherein the decorative trim member has an inverted U-shaped cross-section with grooves along the opposing upper outsides of the runner member capable of being engaged by the upper spline member.

21. A suspended ceiling as in claim 18, wherein the decorative trim member has an inverted U-shape and wherein the largest overall horizontal dimension is not less than the largest overall horizontal dimension of the engaging spline member.

22. A suspended ceiling as in claim 18, wherein the decorative trim member is of sufficient height that the lower surface of ceiling panels engaged by the support runner system and the lowest horizontal surface of the decorative trim member lie in the same horizontal plane.

23. A suspended ceiling as in claim 18, wherein at least one outside vertical surface of the spline member is in coplanar relationship with the corresponding outside vertical surface of the engaged decorative trim member.

24. A suspended ceiling as in claim 18, wherein respectively mated longitudinal grooves along the spline and decorative trim members have a common horizontal bearing surface which is parallel to the engageable horizontal slot at the top of the spline member.

25. A suspended ceiling as in claim 18, wherein the slot at the upper edge of the spline member is comprised of upwardly then inwardly extending flanges extending from the opposing upper outside edges of the spline member wherein the inwardly oriented flanges lie in co-planar horizontal relationship and wherein the slot is sufficiently open between the inwardly oriented flanges to allow movement of the vertical web portion of the supportingly engaged inverted-T runner.

26. A suspended ceiling as in claim 18, wherein the upper supporting member comprises an inverted-T runner having a rigid connection at its top portion wherein upon disengagement of the spline member due to exposure to heat the web of the inverted-T separates and the separated inverted-T runner continues to support the ceiling tile.

27. A suspended ceiling as in claim 18, wherein the upper supporting inverted-T runner member has a stiffening section on its top portion.

28. A suspended ceiling as in claim 18, wherein the upper supporting member comprises an inverted-T runner having the opposing cross-portions at the lower edge for engaging the spline member.

29. A suspended ceiling as in claim 18, wherein the decorative trim member comprises a hollow member formed with opposing outside upper portions being grooved and capable of being engaged by the spline member.

30. A suspended ceiling as in claim 18, wherein the spline member comprises a hollow channel with grooved opposing inside portions capable of engaging the decorative trim member.

* * * * *

UNITED STATES PATENT OFFICE
CERTIFICATE OF CORRECTION

Patent No. 4,063,391 Dated December 20, 1977

Inventor(s) Henry A. Balinski, Hoffman Estates; Robert C. Grupe, Jr. Algonquin, both of Illinois.

It is certified that error appears in the above-identified patent and that said Letters Patent are hereby corrected as shown below:

Column 1, line 10, change "crossrunners" to --cross-runners--.

Column 2, line 9, change "an an" to --and an--.

Column 2, line 35, change "inverted-T-" to --inverted-T --.

Column 6, line 38, change "willdeteriorate" to --will deteriorate--.

Column 7, line 7, change " "V" generally" to --"V" with generally--.

Column 9, line 27, change "runnercontinues" to --runner continues--.

Column 12, line 3, change "co-planar" to --coplanar--.

Signed and Sealed this

Eighteenth Day of April 1978

[SEAL]

Attest:

RUTH C. MASON
Attesting Officer

LUTRELLE F. PARKER
Acting Commissioner of Patents and Trademarks